US011950672B1

(12) United States Patent
Partin, II

(10) Patent No.: US 11,950,672 B1
(45) Date of Patent: Apr. 9, 2024

(54) DIAPER BAG VACUUM

(71) Applicant: Roy Franklin Partin, II, Bagwell, TX (US)

(72) Inventor: Roy Franklin Partin, II, Bagwell, TX (US)

( * ) Notice: Subject to any disclaimer, the term of this patent is extended or adjusted under 35 U.S.C. 154(b) by 534 days.

(21) Appl. No.: 17/006,844

(22) Filed: Aug. 30, 2020

Related U.S. Application Data

(60) Provisional application No. 62/894,251, filed on Aug. 30, 2019.

(51) Int. Cl.

| | |
|---|---|
| ***A45C 15/00*** | (2006.01) |
| ***A45C 3/00*** | (2006.01) |
| ***A45C 13/10*** | (2006.01) |
| ***A47L 7/00*** | (2006.01) |
| ***A47L 9/10*** | (2006.01) |
| ***A47L 9/12*** | (2006.01) |

(52) U.S. Cl.
CPC ..... *A45C 15/00* (2013.01); *A45C 3/001* (2013.01); *A45C 13/103* (2013.01); *A47L 7/009* (2013.01); *A47L 9/102* (2013.01); *A47L 9/12* (2013.01)

(58) Field of Classification Search
CPC ..... A47L 7/0085; A47L 7/009; A47L 9/149; A47L 5/36
See application file for complete search history.

(56) References Cited

U.S. PATENT DOCUMENTS

| | | | | | |
|---|---|---|---|---|---|
| 6,151,749 | A * | 11/2000 | Berfield | A47L 5/36 | 15/327.5 |
| RE37,081 | E * | 3/2001 | Eriksen | A47L 5/36 | 15/327.5 |
| 9,277,844 | B1 * | 3/2016 | Millan | A47L 9/244 | |
| 2002/0026775 | A1 * | 3/2002 | Murphy | A47L 9/1666 | 55/467 |
| 2007/0157419 | A1 * | 7/2007 | Barker | A47L 5/14 | 15/328 |
| 2010/0139223 | A1 * | 6/2010 | Ryan | A47L 5/38 | 55/429 |
| 2012/0061438 | A1 * | 3/2012 | Manor | A47L 5/00 | 224/576 |
| 2013/0061419 | A1 * | 3/2013 | Patrono | F04B 35/002 | 15/300.1 |
| 2016/0375946 | A1 * | 12/2016 | White, Jr. | A45C 15/06 | 362/156 |

* cited by examiner

*Primary Examiner* — Andrew A Horton

(57) ABSTRACT

The present invention discloses a diaper bag vacuum apparatus. The diaper bag is integrated on a vacuum system for cleaning up the mess such as food waste that is often created by the small infants. The vacuum system comprises one or more vacuum components include, an air handling tube, a solid separator assembly, a container, a motor, a blower or fan, a rechargeable battery and an exhaust tube, which are vacuum mounted in the cavity of a pull-out drawer beneath the diaper bag. A detachable hose is attached to the vacuum system via intake port to pick up debris from the floor. A filter in the solid separator allow only air and captures the debris inside the container. Further, the apparatus is battery operable, which enables the fan pulls the air into the center of the fan and ejects it into the exhaust tubing and released to the environment.

17 Claims, 6 Drawing Sheets

DIAPER BAG VACUUM

BACKGROUND OF THE INVENTION

A. Technical Field

The present invention generally relates to a child care product. More specifically, the present invention related to a diaper bag integrated with a vacuum system to cleaning up the mess created by small infants.

B. Description of Related Art

There are various types of diaper bags are known in the art. Many diaper bag designs are attempted to address the issue of carrying the numerous items, such as diapers, food, clothing and toys. However, the increasing number of disposable items sold for child care has complicated matters, and as a result parents look for progressively more flexible bags, able to carry a particular desired mix of products. As a result, a number of bags have been developed, each having a different structure addressing the similar problems.

The expressly designed diaper bag has experienced an explosion of styles, colors, designs, and functions over the last few years. The modest diaper bags are basically just a tote for carrying supplies needed for infants. A portable storage for diaper supplies and other necessary items is always a requirement for the parent or caregivers of infants who are on brief or prolonged outings.

The utility of design of diaper bag could range from a simple and utilitarian design to elaborate and expensive designer bags. Many famous designers such as Kate Spade, Coach, and Ralph Lauren have launched their versions of the diaper bag. Designers are applying their skills to capture the attention of parents and parents-to-be who are willing to pay top dollar for designs that follow the blend of fashion and function. The diaper bag has always been along with the parent in some form or another since anyone with infant has ventured away from home for any length of time that would require a change of diapers. The convenience of modern diaper bags with their many specialized compartments can make the undertaking of keeping the infant changed, fed, and entertained a much less arduous task.

The caregiver takes the child to play or eat and child often scatters pieces of the snacks or crumbs from crackers or cookies all over the table, park bench, car seats, etc. Many times, the surface upon which the debris is scattered, can be too rough or convoluted to allow wiping it off even with a moist napkin, which leaves considerable residue behind in crevices and seams. It is unhygienic and very inconvenient to the caregiver. An issue that often arises when on outing with infant is the mess they often create when feeding or other activities. Further, some of the favorite foods of infants is cereal or other items that are small or crumble into small bits easily. Regardless of the source there is usually a mess associated with the infant's activity whether it involves food or other types of materials.

Typically, the caregiver could carry a small vacuum for a quick and easy cleanup when facing a messy situation that involves very small bits of material or food when caring for an infant during away from home. Bringing along the vacuum cleaner is not easy and most people could not carry since it would be another piece of equipment that would be carried around and the user have to keep track of it. Though, there are many cordless and small vacuum cleaners on the market, the bulk of such item is usually prohibitive in some places. Also, it is not convenient to user.

Therefore, there is a need for a specially designed diaper bag integrated with a vacuum system to provide a practical solution and convenience for caregivers or parents to cleaning up the mess created by small infants.

SUMMARY OF THE INVENTION

The present invention generally discloses a child care product. Further, the present invention discloses a diaper bag integrated with a vacuum system for modern parents or caregivers in order to cleaning up the mess such as food wastes created by infants.

According to the present invention, the diaper bag vacuum apparatus is an innovative and unique child care product. The apparatus is designed to be a practical solution to relieve parents or caregivers from cleaning up the mess such as food waste that is often created by the small infants. In one embodiment, the apparatus is designed as fusion of diaper bag and a vacuum system. The diaper bag is integrated on the vacuum system, thereby providing convenience to the caregiver when traveling with the infants. The vacuum system comprises a hose to pick up debris from the floor, which is created by the infants. In one embodiment, the hose is a flexible hose, which is detachably connected to the vacuum system.

In one embodiment, the vacuum system is a permanent part of the diaper bag, which eliminates tedious tasks of removing debris left by infants or toddlers. In one embodiment, the diaper bag is sewn using wipeable nylon fabric. The diaper bag is an enclosure of front, back, top bottom and side walls or panels. The top panel of the diaper bag comprises at least one top opening, wherein the top opening is provided with a zipper to enclose the diaper bag. In one embodiment, the diaper bag comprises a bag body, a handle, and a fastening assembly. The diaper bag further comprises one or more external compartments or packets at the outside of bag body. The pockets could be zipped or open-end pockets. The inside partition of bag body and the external compartments are utilized for the storage of products such as diapers, wipes, baby rearing items or other hygienic products that are required for the modern parents or caregivers of infants.

In one embodiment, the handle comprises at least two straps configured to mold to the bag body via fastening assembly, wherein one strap is attached to the front panel and the other strap is attached to the back panel of the bag body. In one embodiment, the distal ends of the straps are directly attached to the bag body via the fastener assembly. In another embodiment, the distal ends of the straps comprise one or more ring bases, which are attached to the front and back panel of the bag body via durable nylon fabric. The handle straps are made of at least one of a material selected from the group comprising, plastic, rubber, leather or other suitable durable material. Further, the fastener assembly could be at least any one swing anchor fastener, nuts, bolts and screws or hook fasteners.

In one embodiment, the vacuum system is a molded plastic enclosure. A pull-out drawer is slidably mounted to the plastic enclosure of vacuum system via front opening. The pull-out drawer comprises two side panels, a front panel, a back panel, and a bottom panel. In one embodiment, a pair of adjacent side walls of plastic enclosure and pull-out drawer comprises an exhaust hole/port to eject the air in the tubing. In one embodiment, the front panel comprises a hose attachment port, through which the flexible hose is removably connected to the apparatus. In one embodiment, the hose is a 3' flexible, wire reinforced vinyl hose with two ends. One end of the hose is a cylindrical end to fit into the hose attachment port, whereas the other end is a rectangular end to picking up the debris, easily. In one embodiment, the rectangular end is configured as rectangular slanted end which vacuums the flat surfaces.

In one embodiment, the vacuum system comprises one or more vacuum components include, an air handling tube, a solid separator assembly, a container, a motor, a blower or fan, a battery and an exhaust tube, which are vacuum mounted in the cavity of sliding drawer beneath the diaper bag. In one embodiment, the air handling tube is molded using translucent acrylic plastic with two ends. One end of the air handling tube is in communication with the intake port or hose attachment port to which the flexible hose will be connected, whereas the other end is connected to the solid separator assembly. In one embodiment, the solid separator assembly comprises a separator, diverter and a filter. The separator and diverter force the air comprising vacuumed debris into the container. The air released from the container passes through the filter solid separator assembly. In one embodiment, the filter is a removable and washable filter comprises 2 layers of vinyl plastic small orifice screen pleated with 2 layers of nylon fabric to screen the debris of air stream comes out from the container. The filter allows only the air and captures the debris inside the container.

Further, the vacuum system operates using the rechargeable battery. The motor drives the squirrel cage molded plastic fan at the speed of about 3600 rpm, which enables the fan to pull the air passes through the filter into the center of the fan and ejects it into the exhaust tubing or exit tubing and released to the environment. In one embodiment, the exhaust tube is in communication with the exhaust port molded in the front panel. In one embodiment, the front panel comprises a power switch, a universal serial bus (USB) port, and one or more light emitting diode (LED) indicator. The DC input power is supplied to the apparatus via adapter through the USB receptacle. In addition, a latch is used to close the pull-out drawer with vacuum components.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
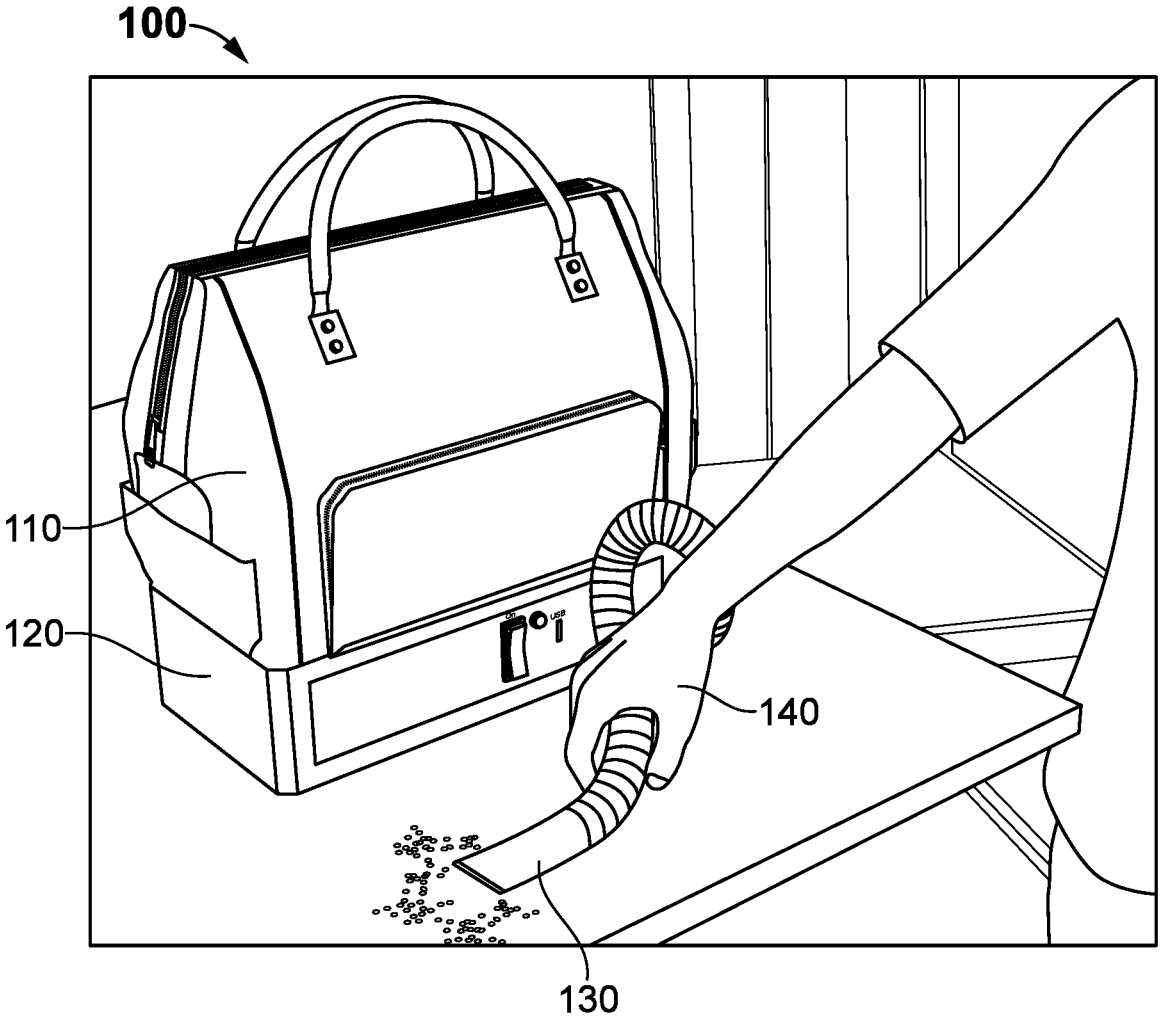
FIG. 1 shows a perspective view of a diaper bag vacuum apparatus attached to a hose in a typical use case in an embodiment of the present invention.

Referring to FIG. 1, a diaper bag vacuum apparatus 100 is an innovative and unique child care product is illustrated, according to the present invention. The apparatus 100 is designed as a practical solution to relieve parents or caregivers 140 from cleaning up the mess such as food waste that is often created by small infants. In one embodiment, the apparatus 100 is designed as fusion of diaper bag 110 and a vacuum system or vacuum cleaner assembly 120. The diaper bag 110 is integrated on the vacuum system 120, thereby providing convenience to the caregiver when traveling with the infants. The vacuum system 120 comprises a hose 130 to pick up debris from the floor, which is created by the infants. In one embodiment, the hose 130 is a flexible hose, which is detachably connected to the vacuum system 120.

Figure 2:
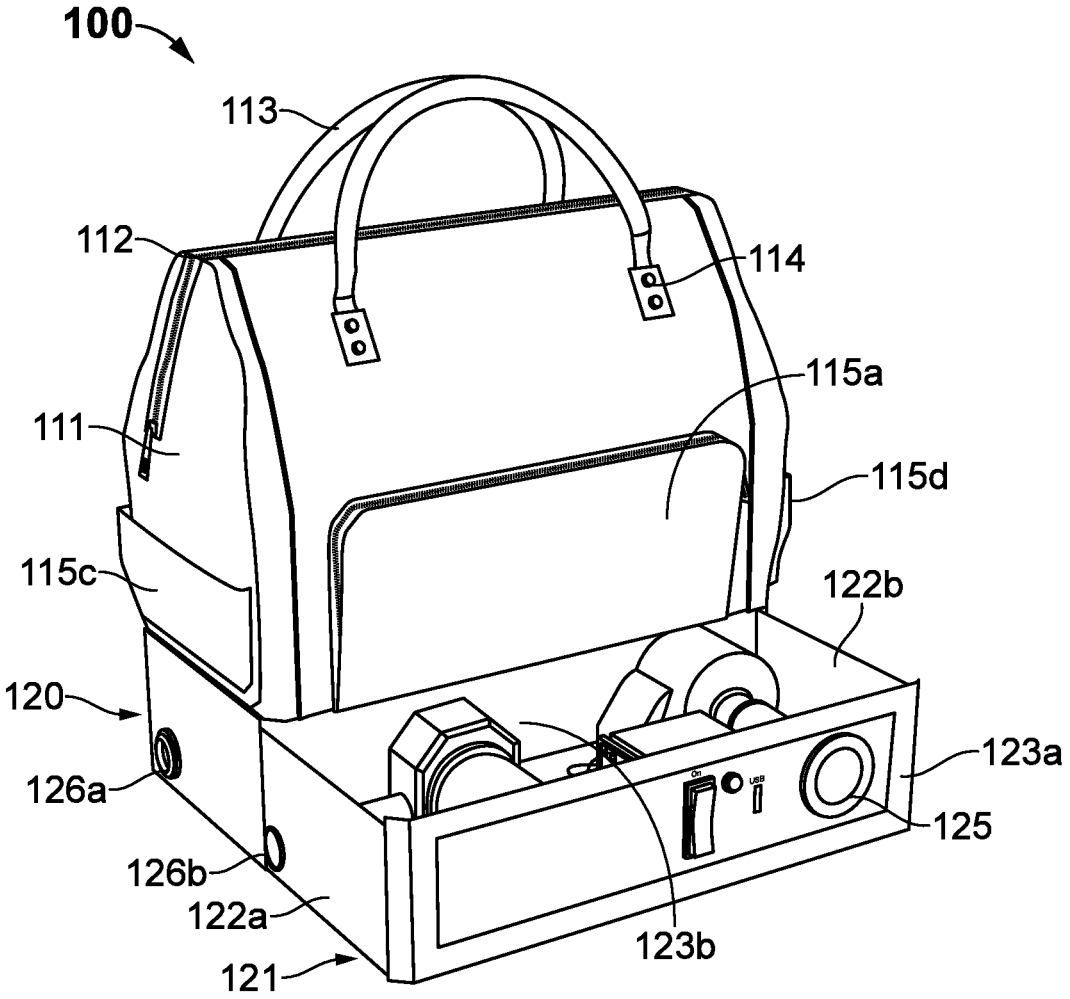
FIG. 2 shows a front perspective view of the apparatus in one embodiment of the present invention.

FIG. 2 exemplarily illustrates a front perspective view of the apparatus 100, wherein the vacuum system 120 is a permanent part of the diaper bag 110, according to one embodiment of the present invention, which eliminates the tedious tasks of removing debris left by infants or toddlers. In one embodiment, the diaper bag 110 is sewn using wipeable nylon fabric. In some embodiments, the diaper bag 110 could be sewn using cotton or other suitable and durable eco-friendly materials. The diaper bag 110 is an enclosure of front, back, top bottom and side walls or panels. The top panel of the diaper bag 110 comprises at least one top opening 112, wherein the top opening 112 is provided with a zipper to enclose the diaper bag 110. The diaper bag 110 comprises a bag body 111, a handle 113, and a fastening assembly 114. Inside the diaper bag 110, the bag body 111 is divided into multiple partitions below the zipper at the top opening 112. Further, the diaper bag 110 comprises one or more external compartments or packets (115*a*-115*d*) at the outside of bag body 111. The pockets could be zipped or open-end pockets. In one embodiment, the packets in the front and back walls (115*a* and 115*b*) are zipped pockets. In one embodiment, the pockets at the side walls (115*c* and 115*d*) are open end pockets. The inside partition of bag body 111 and the external compartments (115*a*-115*d*) are utilized for the storage of products such as diapers, wipes, baby rearing items or other hygienic products that are required for the modern parents or caregivers of infants.

Figure 3:
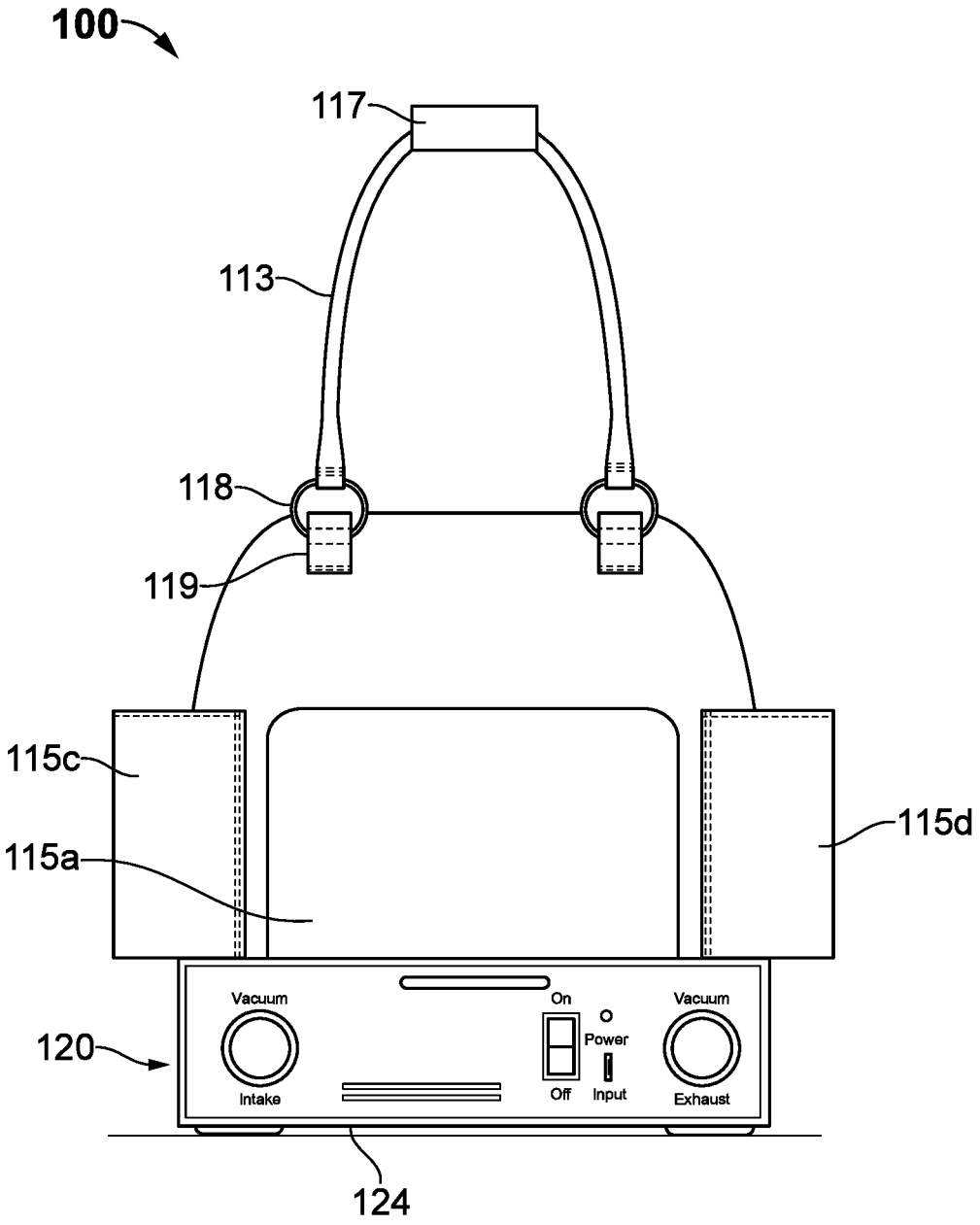
FIG. 3 shows a front view of the apparatus in another embodiment of the present invention.

In one embodiment, the handle 113 comprises at least two straps configured to mold to the bag body 111 via fastening assembly 114, wherein one strap is attached to the front panel and the other strap is attached to the back panel of the bag body 111. In one embodiment, the distal ends of the straps are directly attached to the bag body 111 via the fastener assembly 114. In another embodiment, the distal ends of the straps comprise one or more ring bases 118, which are attached to the front and back panel of the bag body 111 via durable nylon fabric 119 (as shown in FIG. 3).

The handle straps 113 are made of at least one of a material selected from the group comprising, plastic, rubber, leather or other suitable durable material, which allows the user to carry the apparatus 100. Further, the fastener assembly 114 could be at least any one swing anchor fastener, nuts, bolts and screws or hook fasteners.

The vacuum system 120 acts as a base for the diaper bag 110, which is wide enough to allow the apparatus to be placed in areas such as in the seat, on the console, or onto any flat place without it turning over, even when fully loaded with items. In one embodiment, the housing of vacuum system 120 is a molded plastic enclosure comprises a top, bottom, back and two side panels. A pull-out drawer or sliding drawer 121 is slidably mounted to the plastic enclosure of vacuum system 120 via front opening. The pull-out drawer comprises two side panels (122*a* and 122*b*), a front panel 123*a*, a back panel 123*b*, and a bottom panel 124 (shown in FIG. 3). A top opening of the pull-out drawer 121 is covered with the top panel of the plastic enclosure when the pull-out drawer 121 in closed position or sliding the pull-out drawer 121 inside the enclosure. In one embodiment, at least one pair of adjacent side walls of plastic enclosure and pull-out drawer comprises an exhaust hole/ports (126*a* and 126*b*) respectively, to eject the air in the tubing.

In one embodiment, the front panel 123*a* comprises a hose attachment port 125, through which the flexible hose 130 is removably connected to the apparatus 100 (as shown in FIG. 1). In one embodiment, the hose 130 is a 3' flexible, wire reinforced vinyl hose. In one embodiment, the hose attachment port 125 is a vacuum intake port. In one embodiment, the hose 130 is molded with a flexible rubber. The hose 130 comprises two ends. One end of the hose 130 is a cylindrical end to fit into the hose attachment port 125, whereas the other end is a rectangular end to picking up the debris, easily. In one embodiment, the rectangular end is configured as rectangular slanted end which vacuums the flat surfaces. Also, the slanted end acts like a crevice tool for cleaning out the debris in sewn seams and corners. Further, the hose 130 could be removed and re-stored in the diaper bag 110 for future use.

Figure 4:
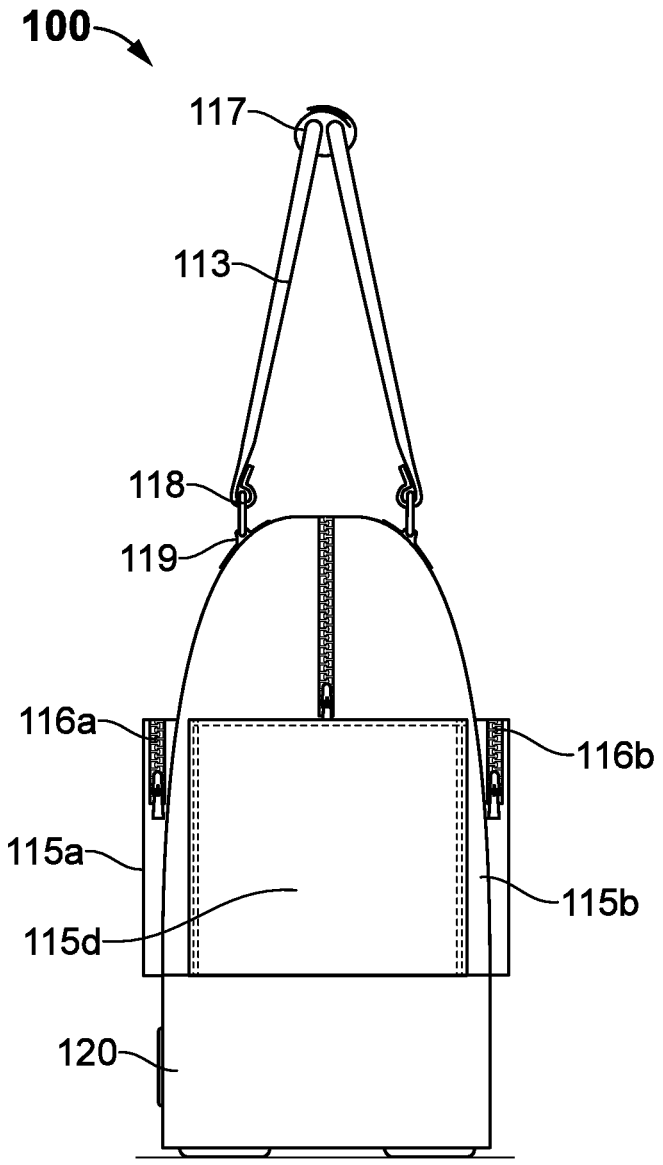
FIG. 4 shows a side view of the apparatus in one embodiment of the present invention.

Referring to FIGS. 3 and 4, a front view and a side view of the apparatus 100 is disclosed respectively, according to one embodiment of the present invention, wherein the one or more handle straps 113 are clustered together using a fabric wrap 117 that is sewn to the bag body 111. The fabric wrap 117 comprises a fastener to secure the handle straps 113 together. In one embodiment, the fastener could be a hook and loop (H&L) fastener. Further, the handle straps 113 comprise one or more ring bases 118 at their distal ends, which connect the handle straps 113 to the corresponding durable nylon fabric 119. In one embodiment, the ring base is a D-ring attachment. The handle straps 113 are sewn to the front and back panel of the bag body 111 via durable nylon fabric 119. In some embodiments, the handle straps 113 could be attached to the bag body 111 using fasteners 114. The fasteners 114 could be at least any one swing anchor fastener, nuts, bolts and screws or hook fasteners. Further, the handle 113 could be made of at least one of a material selected from the group comprising plastic, rubber, leather or other suitable durable material, which allows the user to carry the apparatus 100.

Further, the diaper bag 110 comprises one or more external compartments or packets (115*a*-115*d*) at the outside of bag body 111 include, front packet 115*a*, back packet 115*b* and side packets (115*c* and 115*d*). In one embodiment, the exhaust port 126 is molded on the front panel 123*a* instead of side panel 122*a* (as shown in FIG. 2). The pockets could be zipped or open-end pockets. In one embodiment, the packets in the front and back walls (115*a* and 115*b*) are zipped pockets, which comprise zippers (116*a* and 116*b*) to close the respective packets. In one embodiment, the pockets at the side walls (115*c* and 115*d*) are open end pockets. The inside partition of bag body 111 is utilized for the storage of products such as diapers, wipes, baby rearing items or other hygienic products that are required for the modern parents or caregivers of infants, while the external compartments (115*a*-115*d*) are utilized to store the cell phone, car keys, water bottles, etc.

Figure 5:
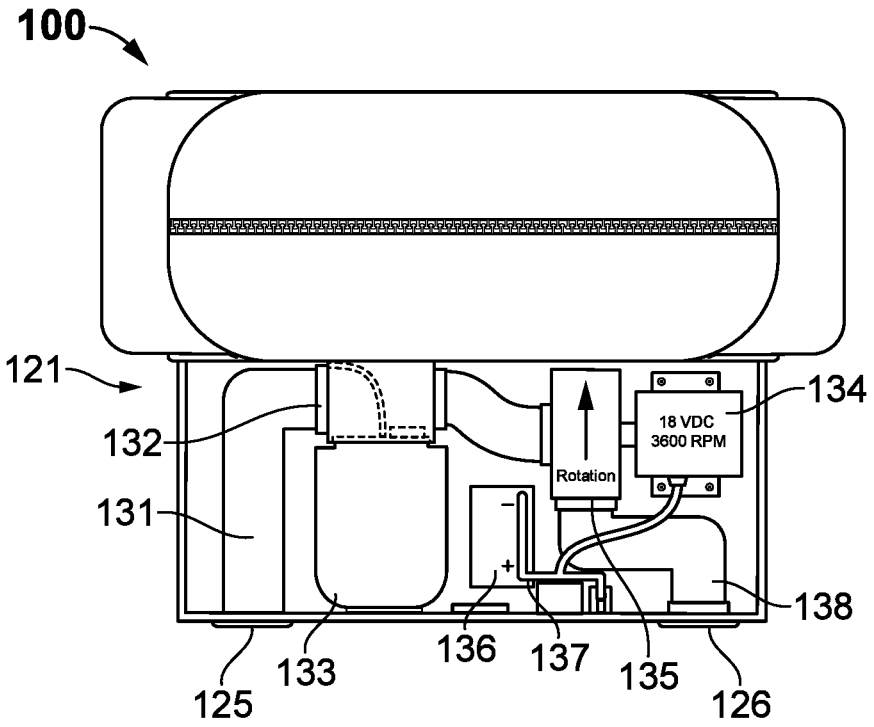
FIG. 5 shows a top view of the apparatus in one embodiment of the present invention.

Referring to FIG. 5, a top view of the apparatus 100, where the pull-out drawer 121 of the vacuum system 120 is in an open position or slide out from the enclosure. In one embodiment, the vacuum system 120 comprises, an air handling tube 131, a solid separator assembly 132, a container 133, a motor 134, a blower or fan 135, a battery 136 and an exhaust tube 138, which are vacuum mounted in the cavity of sliding drawer 121 beneath the diaper bag 110. In one embodiment, the vacuum system 120 operates using the battery 136, which is a rechargeable battery. In one embodiment, the battery 136 is a 2-Ahr rechargeable battery, which is capable of operate the vacuum system 120 without recharging for a period of not less than 30 minutes.

In one embodiment, the air handling tube 131 is molded using translucent acrylic plastic, which enables the user to easily observer and clean the air handling tube 131 in case of any clogs or obstructs present inside the tube duct. One end of the air handling tube 131 is in communication with the intake port or hose attachment port 125 to which the flexible hose 130 will be connected, whereas the other end is connected to the solid separator assembly 132. The solid separator assembly 132 comprises a separator, diverter and a filter. In one embodiment, the diverter or diffuser is used to deflect the air sideways without affecting the efficiency of the vacuum. The separator and diverter force the air comprising vacuumed debris into the container 133. The container 133 is a capture bottle or a clear transparent oval container with round opening, and is removably positioned by a rubber block at the front of the door, which presses the round opening against the gasket to make it airtight. The air released from the container 133 passes through the filter solid separator assembly 132. In one embodiment, the filter is a removable and washable filter comprises 2 layers of vinyl plastic small orifice screen pleated with 2 layers of nylon fabric to screen the debris of air stream comes out from the container 133. The filter allows only the air and captures the debris inside the container 133, which could be observed and removed for dumping.

In one embodiment, the motor 134 is a 18 Volt battery powered motor. The motor 134 drives the squirrel cage molded plastic fan 135 at the speed of about 3600 rpm, which enables the fan to pull the air passes through the filter into the center of the fan and ejects it into the exhaust tubing or exit tubing 138. In one embodiment, the exhaust tube 138 is in communication with the exhaust port 126 molded in the front panel 123*a*. In one embodiment, the vacuum system 120 further comprises a molded plastic conduit 137, which protects the wiring and any electronics from inadvertent contact that may occur when the container 133 is being emptied.

Figure 6:
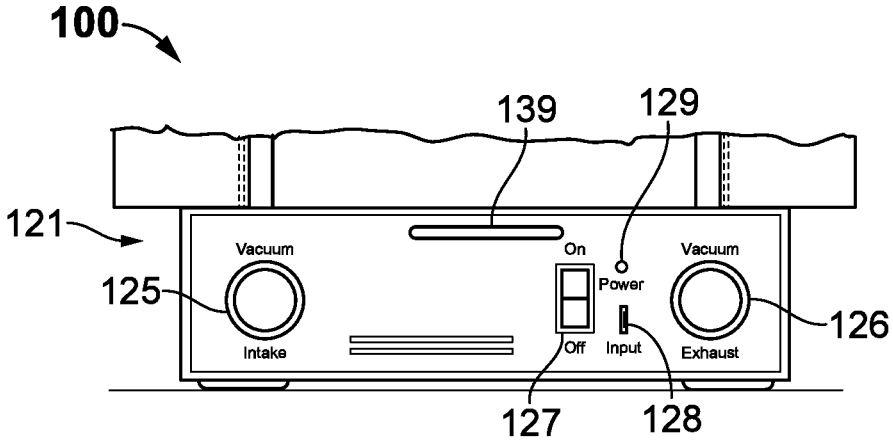
FIG. 6 shows a cross-sectional view of the apparatus in one embodiment of the present invention.

Referring to FIG. 6, a cross-sectional view of the apparatus 100 comprises the front panel 123*a* of the pull-out drawer 121 of vacuum cleaner assembly 120, according to one embodiment of the present invention. The front panel 123*a* comprises a power switch 127, a universal serial bus (USB) port 128, and one or more light emitting diode (LED) indicator 129. The DC input power is supplied to the apparatus 100 via adapter through the USB receptacle 128. The power switch 127 is configured to turn-on or turn-off the apparatus 100 during usage. In addition, the LED indicator 129 is utilized as a warning light. In one embodiment, the LED indicator 129 comprises 3 phases include, but not limited to, red, amber and green. The various LED indication provides information about the battery charge level. In one embodiment, the green indicates good such as fully charged battery level or average battery level, the amber indicates low charge level, and the red indicates that the battery needs to be charged immediately. The front panel 123*a* further illustrates the hose attachment port 125 to connect with the flexible hose 130, exhaust port 126 to exit the filtered air from the vacuum cleaner assembly 120, and a latch 139 to close the pull-out drawer 121. The latch 139 is a finger latch, which holds the pull-out drawer 121 in the closed position until the user wants to dump the dry debris bottle 133. In one embodiment, the latch 139 is a spring-loaded latch. In some embodiments, the latch could be buckle latch, slam latch, toggle latch or other suitable latches.

The apparatus 100 is fabricated, but not limited to, the following materials and processes. The bag 110 is sewn from 300 denier nylon or any other non-hypoallergenic, wipeable durable fabric. The material is cut to shape using computer controlled rolling cutters. The two halves are joined using a single stitch around the perimeter and then the bag 110 is turned inside out to develop a finished edge at the join. The #10 sports zipper is sewn to the upper surface or top surface of the center opening 112 and to the appropriate openings in the side pockets (115*a*-115*d*), which have been previously sewn to sides of the bag 110 when it is in the flat condition. All edges are turned under and single stitched to make a high-quality finished edge. The end pockets (115*a*-115*d*) are double stitched onto the bag 110 at the most opportune time for ease of sewing and the upper attachment corners are reinforced using a serger stitch. The bottom of the bag is adhesively bonded & riveted to the plastic base of the enclosure 120. The rivets reinforce the bag 110 attachment and insure it remains joined to the base of the enclosure 120 over the useful life of the product 100. The handles or shoulder straps 113 are rolled and sewn from the same fabric, then are fed through the D rings 118, secured to the bag 110 with strips of fabric sewn to the bag body 111, and the shoulder straps 113 are double stitched for strength.

The enclosure 120 is the vacuum cleaner assembly comprises a pull-out drawer 121. The enclosure 120 and pull-out drawer 121 are injection molded from polypropylene plastic. This plastic is very durable, is highly resistant to household chemicals and UV degradation, and is typically used in this type of application. The enclosure 120 and pull-out drawer 121 can be supplied in almost any vibrant color, so a distinctive color may be chosen to enhance the product recognition factor, which can dramatically improve the market adoption of the product. The enclosure 120 could match, complement, or clash with the bag color(s), whichever look the designer is trying to achieve. The interior sides of the enclosure 120 and pull-out drawer 121 have mating slides, which enables the pull-out drawer 121 opens and closes smoothly but is prevented from sliding out completely unless the stop is forced outward. The pull-out drawer section 121 is silk-screened and then supplied to the enclosure or vacuum assembly group 120.

The vacuum components are mounted in the pull-out drawer 121 and are fabricated to fit so the air flow and the debris capture are optimized. The components are, but not limited to, the following items. The air handling tubes 131 comprises 3 air handing tubes. These are 1" diameter, translucent acrylic extruded tubing with an 0.040" wall. The tubing 131 is heated to softening temperature and hydraulically formed into the desired shapes. All exterior radiuses are smooth and designed to allow unimpeded flow of debris and air. After forming, the tubes 131 are seated silicone rubber receptacles at the appropriate components to make the system. The front panel receptacles and exit decorative moldings are an airtight connection to the air handling tubes and a snug slip fit to the vacuum hose 130 and the deflector or exhaust tube 138.

The flexible vacuum hose 130 has a 3' long, wire reinforced, vacuum hose onto which the ends are molded. One end fit into either airflow port 125 on the pull-out drawer 121 and the other is slanted rectangular end that acts like a crevice tool. This allows easy cleanup of dry debris on almost any surface. It is designed to be stored in one side of the partitioned interior of the diaper bag 110 when not is use.

The exhaust tube 138 is an injection molded polypropylene piece fits into the exhaust port 126 of the vacuum system 120. It changes the angle of the exit airstream for the comfort of the user, based on the user requirement. It is translucent and could be removed for storage with the 3' vacuum hose 130.

The solids separator assembly 132 is a plastic unit, which is fabricated in 2 sections, which are adhesively bonded together and clamped to cure. Then the silicone rubber receptacles are adhesively bonded in place and the part is set aside. This component has two rivet holes in the base flange so it could be secured to the drawer bottom.

The solids separator filter is fabricated using 2 layers of vinyl plastic screen and a pleated filter of 2 layers of loose weave nylon fabric, which is surrounded with a silicone rubber interface. This filter is pressed into the solids separator assembly 132 just above the capture container to keep any debris from flowing downstream into the blower and exiting the vacuum. The filter is designed to be washable, if normal cleaning does not suffice.

The debris capture container 133 is blow molded using clear acrylic plastic. The container 133 is an oval shaped bottle and is offset so there is more area below the mating cylindrical opening than above. This helps retain the debris that is vacuumed up and reduces the spillage when removing the bottle 133 for dumping the vacuumed debris. The opening of the debris bottle 133 fits into a silicone rubber gasket in the separator assembly 132 and held in place firmly with a rubber compression piece mounted on the inside of the pull-out drawer 121.

The motor 134 and blower/fan 135 are commercially available components, which are composed of a standard squirrel cage blower with a center opening and edge mounted outlet and a DC motor. The blower motor shaft has two large permanently lubricated bearings, for easily supporting the blower 135 during operation over a very long product life. The 18 VDC motor 134 has an unloaded speed of 3600 rpm and can drive the blower 135 for up to 30 minutes continuously on one battery charge. The motor 134 has a mounting flange that is adhesively bonded and riveted to the bottom of the pull-out drawer 121 for rigidity.

The electronic controls of the vacuum system 120 is achieved with a rocker switch 127 mounted in the front panel 123*a*. There are several sub-components required for this simple control of the vacuum motor 134 to work efficiently and effectively. These are, but are not limited to, the following:

The battery 136 is an 18-volt battery, which is a compact Li-Ion gel battery. The battery 136 is sealed so no fumes are present within the cavity. The 2.0 Amp Hour battery 136 has enough power to run the vacuum motor 134 and peripheral components for 30 minutes of continuous operation without requiring a charge. The battery 136 is secured to of the drawer bottom using 4 stainless-steel fasteners through the bottom of the drawer 121 into nuts cast into the battery case.

The smart charger provides control over the 20 VDC sent to the system from the adapter and power cable. It also monitors the temperature of the battery 136 and slows the charging rate of the temperature gets close to the limits set in the firmware program. This smart charger is part of the PCB.

The power adapter is 2-inch width, 4-inch length and 1-inch thickness power adapter, which provides 2.0 A current at 20 VDC to the system to recharge the battery 136. The adapter plugs directly into the dwelling 120 VAC mains outlet. The 6' power cord is a USB to USB cord 128 and plugs into the USB receptacle on the front surface 123*a* of the pull-out drawer 121.

The control LED 129 is a 3-lead red/green device. It provides, red, green, and a brownish-yellow color (amber) with both LEDs on. This is used to provide the 3 colors described in the document in a compact, low power requirement package. This device is controlled by the PCB.

The rocker switch 127 is mounted on the front panel 123*a* of the pull-out drawer 121. The switch 127 is a single pole single throw (SPST) device.

Motor driver is an integrated circuit, which is mounted on the PCB. The motor driver is controlled by the switch 127 in the front panel 123*a*. When the switch 127 is engaged, the computer chip turns on the motor driver and keeps it on until the switch is disengaged.

The printed circuit boards (PCB) for the vacuum system 120 is fabricated to the final assembler's requirements in a world class contract electronic assembler facility. The standard thickness, double sided FR4 circuit board material is populated with surface mounted components. Any through-hole devices are inserted after the surface mounted assembly, soldering, and cleaning. The circuit board is designed to have all the components oriented so they could be mounted with the LED illuminators 129 projecting out of the lenses mounted in the housings. After assembly, the PCBs are protected with a moisture adsorption preventive conformal coating.

According to the present invention, the diaper bag vacuum apparatus 100 is designed to be aesthetic and effective in the application. The relative ease of manufacture and the moderately inexpensive components provide good marketability for the manufacturer. The user benefits from using the convenient diaper bag and could easily clean up where the child is playing or eating, which could provide considerable market interest in the product.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. A diaper bag vacuum apparatus for collecting debris, comprising:

a diaper bag;

a vacuum device integrated with the diaper bag;

the vacuum device including a hose to pick up the debris; wherein the diaper bag includes a front panel including a power switch, a universal serial bus (USB) port, and at least one light emitting diode (LED) indicator and the diaper bag including a pull-out drawer having an exhaust port to eject air into the hose.

2. A diaper bag vacuum apparatus for collecting debris as in claim 1, wherein the hose is a flexible hose.

3. A diaper bag vacuum apparatus for collecting debris as in claim 1, wherein the hose is configured to be detachably connected to the vacuum device.

4. A diaper bag vacuum apparatus for collecting debris as in claim 1, wherein the diaper bag is integrally connected to the vacuum device.

5. A diaper bag vacuum apparatus for collecting debris as in claim 1, wherein the diaper bag is formed from a wipeable nylon fabric.

6. A diaper bag vacuum apparatus for collecting debris as in claim 1, wherein the diaper bag includes a top panel having an opening.

7. A diaper bag vacuum apparatus for collecting debris as in claim 6, wherein the opening may be opened and closed with a zipper device.

8. A diaper bag vacuum apparatus for collecting debris as in claim 1, wherein the diaper bag includes at least one pocket formed on the outer surface of the diaper bag.

9. A diaper bag vacuum apparatus for collecting debris as in claim 1, wherein the diaper bag includes a handle to carry the diaper bag vacuum assembly.

10. A diaper bag vacuum apparatus for collecting debris as in claim 9, wherein the handle includes at least two straps.

11. A diaper bag vacuum apparatus for collecting debris as in claim 1, wherein the vacuum device includes a solid separator assembly to separate solid debris.

12. A diaper bag vacuum apparatus for collecting debris as in claim 11, wherein the solid separator assembly includes a separator.

13. A diaper bag vacuum apparatus for collecting debris as in claim 11, wherein the solid separator assembly includes a diverter.

14. A diaper bag vacuum apparatus for collecting debris as in claim 11, wherein the solid separator assembly includes a filter.

15. A diaper bag vacuum apparatus for collecting debris as in claim 14, wherein the filter is detachable.

16. A diaper bag vacuum apparatus for collecting debris as in claim 14, wherein the filter is washable.

17. A diaper bag vacuum apparatus for collecting debris as in claim 1, wherein the vacuum device includes the pull-out drawer allowing access to controls for the vacuum device.

* * * * *